United States Patent [19]

Ichinoseki et al.

[11] Patent Number: 4,655,847

[45] Date of Patent: Apr. 7, 1987

[54] CLEANING METHOD

[76] Inventors: Tsuyoshi Ichinoseki, (Yoshizawa Jutaku E-206) No. 844-2, Yoshizawa-cho; Hirobumi Kato, (Hyakujuen Jutaku D-302) No. 2617-2, Motoyoshida-cho, both of Mito-shi, Ibaragi-ken; Shuji Miyahara, No. 517-4, Kamoshida-cho, Midori-ku, Yokohama-shi, Kanagawa-ken; Harumi Kimuro, No. 4-12-14, Sasage, Konan-ku, Yokohama-shi, Kanagawa-ken, all of Japan

[21] Appl. No.: 631,722

[22] Filed: Jul. 17, 1984

[30] Foreign Application Priority Data

Sep. 1, 1983 [JP] Japan ..... 58-161139
Sep. 27, 1983 [JP] Japan ..... 58-178784

[51] Int. Cl.[4] ..... B08B 7/00

[52] U.S. Cl. ..... 134/7; 51/320; 51/307; 51/410

[58] Field of Search ..... 134/7; 51/320, 307, 51/410

[56] References Cited

U.S. PATENT DOCUMENTS

| | | | |
|---|---|---|---|
| 2,858,653 | 11/1958 | Guptill, Jr. | 51/320 |
| 3,676,963 | 7/1972 | Rice et al. | 51/320 |
| 3,894,364 | 7/1975 | Korn et al. | 51/320 |
| 4,125,969 | 11/1978 | Easton | 51/320 |

FOREIGN PATENT DOCUMENTS

| | | | |
|---|---|---|---|
| 1397102 | 6/1975 | United Kingdom | 51/320 |
| 197801 | 1/1978 | U.S.S.R. | 134/7 |

*Primary Examiner*—Andrew H. Metz
*Assistant Examiner*—Sharon T. Cohen

[57] ABSTRACT

Dry-ice particles are blasted against an object to be cleaned under the presence of ice particles, whereby drawbacks in the case of blasting the dry-ice particles alone can be eliminated.

1 Claim, 3 Drawing Figures

CLEANING METHOD

BACKGROUND OF THE INVENTION

The present invention relates to a method and apparatus for cleaning various machinery and devices used in nuclear plants and more particularly relates to a method and apparatus for cleaning such machinery and devices by blasting dry-ice particles under the presence of ice particles or a surface-active agent.

The conventional cleaning methods of that kind may be roughly divided as follows:

(1) Sand blasting method in which sand particles are blown under high pressure against machinery or devices to be cleaned;

(2) Dry-ice blasting method in which dry-ice particles are blown against machinery or devices to be cleaned;

(3) Ice blasting method in which ice particles are blown against machinery or devices to be cleaned;

(4) Water blasting method; and (5) Liquefied-freon blasting method.

When the sand blasting method is used to clean the machinery and devices of nuclear plants, sand particles blown against the surfaces of these machinery and devices become radioactive waste contaminants so that there arises a problem how to dispose such radioactive waste contaminants. Furthermore, radioactive contaminants are caused to be scattered by dust particles so that there must be provided a method for preventing dust particles from scattering.

In the case of the dry-ice blasting method, the dry-ice particles are vaporized so that the object to be cleaned cannot be seen and consequently the cleaning procedure is adversely affected.

In the case of the ice blasting method, the ice particles are blown against the object to be cleaned. The density of ice is lower than that of dry ice so that the ice blasting method is not so efficient in cleaning efficiency as the dry-ice blasting method.

In the case of the water blasting method, the cleaning efficiency is very low. Moreover, because of a vast amount of water being used, it is very difficult to effect disposal of radioactive waste water.

In the case of the liquefied-freon blasting method in which the liquefied-freon is blasted and the waste freon is vaporised and is withdrawn, the cleaning efficiency is low.

The present invention therefore provides a cleaning method and apparatus in which scattering of dust particles can be prevented and screening by sublimation of dry ice can be prevented so that efficient cleaning of various machinery and devices can be carried out. According to the present invention, dry-ice particles are blasted under high pressure and in the presence of ice particles or a surface-active agent against the surfaces of an object to be cleaned, so that the scattering of radioactive contaminants into the atmosphere can be prevented.

The above and other objects, features and advantages of the present invention will become more apparent from the following description of preferred embodiments thereof taken in conjunction with the accompanying drawings.

DETAILED DESCRIPTION OF THE PREFERRED EMBODIMENTS

Figure 1:
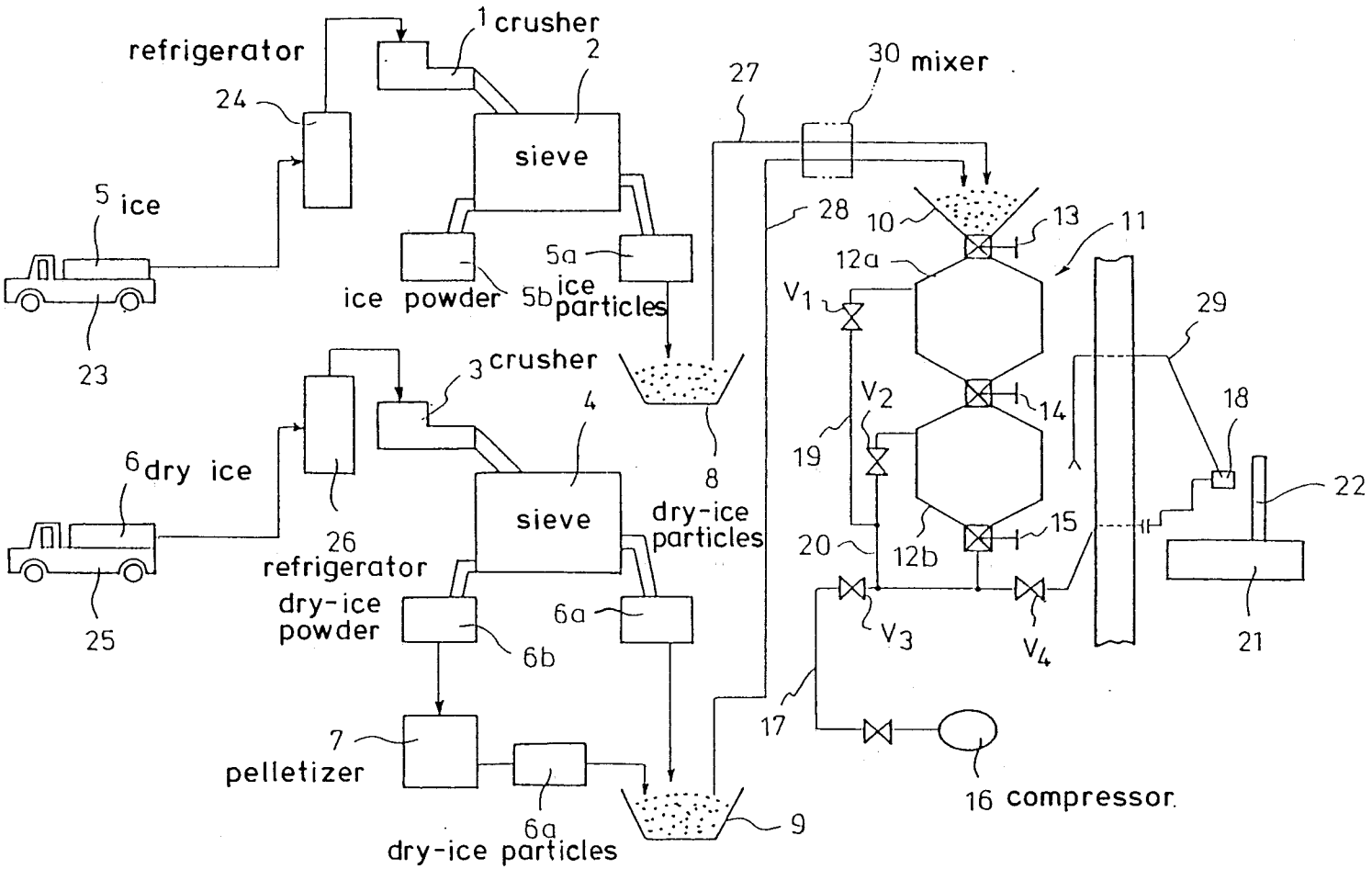
FIGS. 1 and 2 are block diagrams for showing preferred embodiments of the present invention.

FIG. 1 shows in block diagram a preferred embodiment of the present invention in which a crusher is used to produce ice and dry-ice particles. Ice 5 is carried by a truck 23 and is stored in a refrigerator 24 until ice is crushed into particles. In like manner, dry ice 6 is carried by a truck 25 and is stored in a refrigerator 26 until dry ice is crushed into particles.

A block of ice taken out of the refrigerator 24 is transported by a conveyor to a crusher 1. Ice crushed by the crusher 1 is separated by a sieve 2 into ice particles **5*a* and ice powder 5*b* and the ice particles 5*a* are stored in a bucket 8. A block of dry ice 6 taken out from the refrigerator 26 is transported by a conveyor to a crusher 3. Dry ice crushed by the crusher 3 is separated by a sieve 4 into dry-ice particles 6*a* and dry-ice powder 6*b*. The dry-ice particles 6*a* are directly charged into a bucket 9 and the dry-ice powder 6*b* is formed into the dry-ice particles 6*a* by a pelletizer 7 and is charged into the bucket 9**.

The primary feature of the present invention resides in the fact that the ice particles **5*a* and the dry-ice particles 6*a* are mixed at a suitable ratio and impinged against the surface of machinery or devices to be cleaned. A blasting device generally indicated by reference numeral 11 includes a hopper 10 into which are charged the ice particles 5*a* stored in the bucket 8 and the dry-ice particles 6*a* stored in the bucket 9, an upper vessel 12*a* the top of which is communicated through a solenoid-controlled valve 13 with the hopper 10 and a lower vessel 12*b* the top of which is communicated through a solenoid-controlled valve 14 with the bottom of the upper vessel 12*a* and the bottom of which has a solenoid-controlled valve 15. A compressor 16 is communicated through a compressed air line 17 with a blasting nozzle 18 and a valve $V_3$ is disposed in the compressed air line 17 upstream of the solenoid-controlled valve 15 while a valve $V_4$, at downstream of the solenoid-controlled valve 15. A flow line from the solenoid-controlled valve 15 and a flow line from the lower vessel 12*b* are communicated with the compressed air line 17 between the valves $V_3$ and $V_4$. A flow line 19 from the upper vessel 12*a* is communicated with the flow line 20. A valve $V_1$ is inserted in the flow line 19 while a valve $V_2$ is inserted into the flow line 20 downstream of the joint between the flow lines 19 and 20. Therefore the mixture of the ice particles 5a and the dry-ice particles 6*a* is forced through the blasting nozzle 18 under high air pressure against the surfaces of an object 22 to be cleaned which is placed upon a turntable 21. Reference numerals 27 and 28 denote conveyors for the ice particles 5*a* and the dry-ice particles 6*a*, respectively; and 29, a manipulator for controlling the blasting nozzle 18**.

As described above, the block of ice 5 transported by the truck 23 is crushed by the crusher 1 into the ice particles **5*a*. In like manner, the block of dry ice carried by the truck 25 is crushed by the crusher 3 into the dry-ice particles 6*a*. The ice particles 5*a* are transported by the conveyor 27 from the bucket 8 into the hopper 10 while the dry-ice particles 6*a* are transported by the conveyor 28 from the bucket 9 into the hopper 10. In the hopper 10, the ice particles 5*a* are mixed with the dry-ice particles 6*a* at a suitable ratio. The mixture of ice and dry-ice particles 5*a* and 6*a* is charged into the blasting device 11. The blasting device 11 comprises the upper and lower vessels 12***a* and 12*b* which are intercommunicated with each other so that the mixture of the ice and dry-ice particles 5*a* and 6*a* is charged into the compressed air line 17 in a manner to be described below.

When the mixture of the ice and dry-ice particles 5*a* and 6*a* is charged from the hopper 10 into the upper vessel 12*a*, the solenoid-controlled valve 14 and the valve $V_1$ are closed while the solenoid-controlled valve 13 is opened. Thereafter the solenoid-controlled valve 13 and the valve $V_2$ are closed while the solenoid-controlled valve 14 and the valves $V_1$ and $V_3$ are opened so that the mixture of the ice and dry-ice particles 5*a* and 6*a* is charged from the upper vessel 12*a* into the lower vessel 12*b*. Next the solenoid-controlled valve 15 and the valves $V_2$ and $V_4$ are opened so that the mixture of the ice and dry-ice particles 5*a* and 6*a* is transported to the blasting nozzle 18. Simultaneously, the solenoid-controlled valve 14 and the valve $V_1$ are closed while the solenoid-controlled valve 13 is opened so that the mixture of the ice and dry-ice particles 5*a* and 6*a* is charged from the hopper 10 into the upper vessel 12*a*. The above-described operation is cycled so that the mixture of the ice and dry-ice particles 5*a* and 6*a* is continuously transported to the blasting nozzle 18.

The mixture of the ice and dry-ice particles 5*a* and 6*a* is forced to impinge against the object 22 to be cleaned through the blasting nozzle 18 which is remote-controlled by the manipulator 29.

When the mixture of the ice and dry-ice particles 5*a* and 6*a* is impinged on the object 22 to be cleaned, the dry-ice particles 6*a* are crushed so that smoke tends to generate, but at the same time the ice particles 5*a* impinge against the object 22 to be cleaned and are crushed so that mist is formed. As a result, a wet type blasting is carried out. That is, smoke-like evaporation of dry ice can be prevented. As a result, one can clearly observe the object 22 to be cleaned. In other words, the working conditions are improved. Furthermore the wet blasting is carried out so that the scattering of contaminated particles removed by the blasting of the mixture of the ice and dry-ice particles can be prevented.

Moreover, due to latent heat in sublimation of dry ice, the hardness and strength of ice particles are increased so that the cleaning efficiency is improved.

Figure 2:
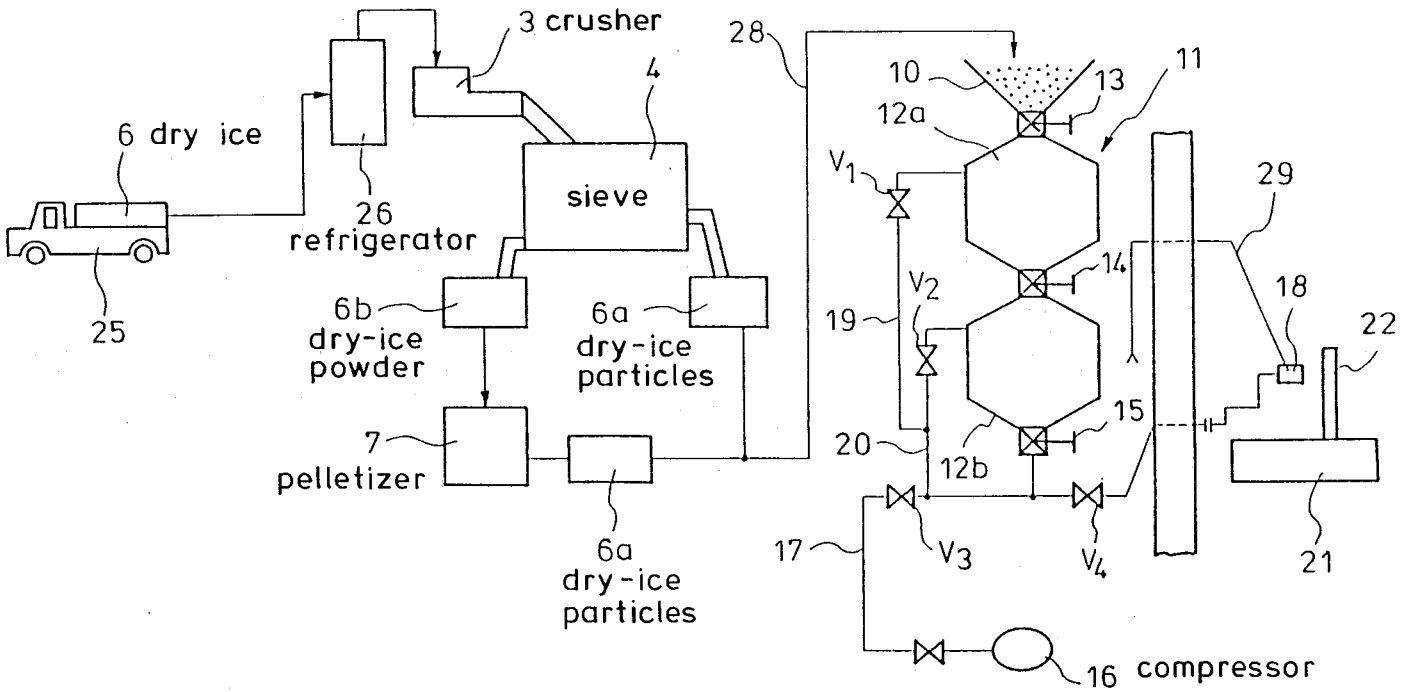

FIG. 2 shows in block diagram another preferred embodiment of the present invention in which a surface-active agent is used in lieu of the ice particles 5*a*. This embodiment is different from the above-mentioned embodiment in that the dry-ice particles 6*a* from the sieve 4 and the pelletizer 7 are directly transported into the hopper 10 through the conveyor 28.

The surface-active agent is employed as an agent for preventing radioactive contaminants from scattering into the atmosphere when the dry-ice particles 6*a* is forced to impinge against the object 22 to be cleaned. That is, the radioactive contaminants are attracted by the surface-active agent and are not entrained on and scattered by the gas produced in the sublimation of the dry ice.

Figure 3:
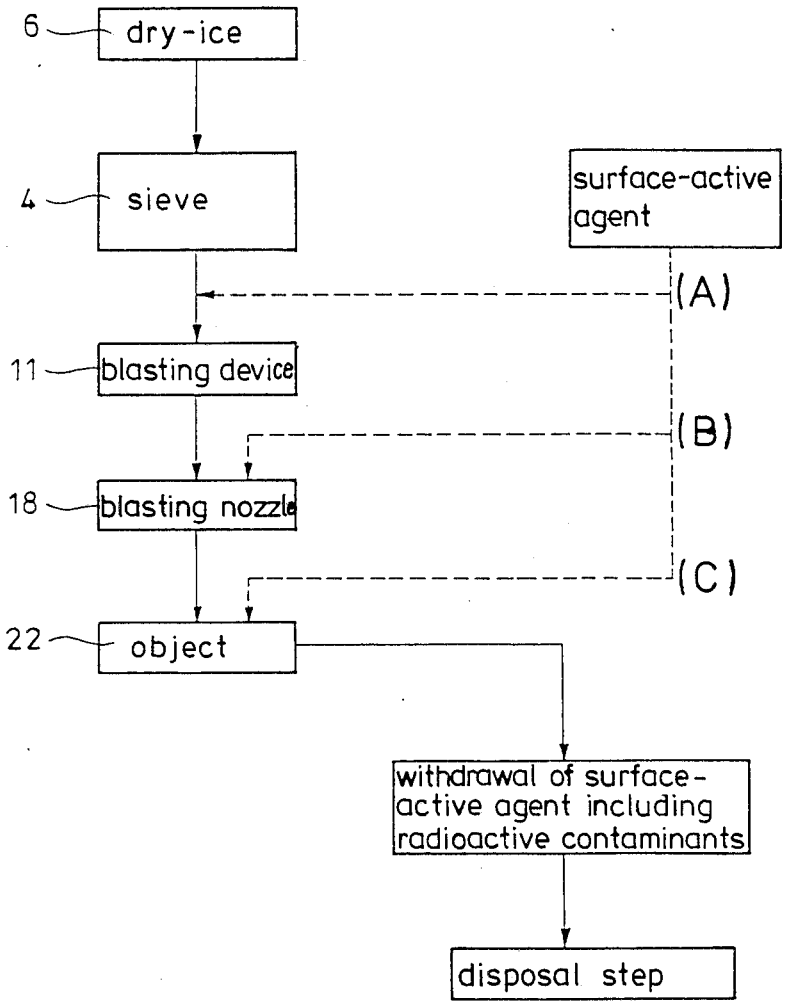
FIG. 3 is a block diagram used to explain the addition of a surface-active agent.

As shown in FIG. 3, the surface-active agent is added in the following three alternative ways:

(A) When the dry-ice particles 6*a* are transported to the blasting device 11, the surface-active agent is added thereto.

(B) The surface-active agent is added to the dry-ice particles 6*a* in the blasting nozzle 18.

(C) The surface-active agent is directly added onto the object 22 to be cleaned before or upon the beginning of the cleaning.

Such scattering-preventive agent may be a surface-active agent affinitive to the radioactive substances and surface materials of the object 22, such as alcohol.

When the dry-ice particles 6*a* are impinged on the object 22, the latter is cleaned by the former and the contaminated particles removed by such blasting are scattered. At the same time, the dry-ice particles 6*a* are crushed on the object 22 so that smoke tends to generate.

However, in the case where the surface-active agent is added as the scattering-preventive agent according to the present invention, the radioactive contaminants are attracted by the surface-active agent and are dropped and therefore are not entrained on and scattered by the gas produced in the sublimation of dry ice. Thus, scattering of the radioactive contaminants into the atmosphere can be reduced and the disposal of the exhaut gases can be easily effected.

As shown in FIG. 3, the exhausted surface-active agent having the radioactive contaminants attached thereto is withdrawn in the withdrawal step and is disposed in the disposal step.

The surface-active agent can prevent the radioactive contaminants from scattering into the atmosphere irrespective of the timing (A), (B) or (C) in FIG. 3.

So far the air has been described as being compressed by the compressor 16 and the blocks of ice and dry ice have been described as being crushed into particles by means of the crushers 1 and 3, respectively, and then separated into the particles and powder by the sieves 2 and 4, respectively; but it is to be understood that instead of the compressor 16 any other suitable means may be used and that any other suitable means may be employed to prepare the ice particles and the dry-ice particles. It is to be further understood that as shown by imaginary line in FIG. 1 a mixer 30 may be disposed between the ice particle bucket 8 and the dry-ice particle bucket 9 on the one hand and the hopper 10 on the other hand so that the mixer 30 mixes the ice particles with dry-ice particles before they are charged into the hopper 10. Moreover, the blasting device 11 has been described as comprising the upper and lower vessels 12*a* and 12*b*, but it is to be understood that the blasting device 11 may comprise only one vessel. In addition, it is to be understood that many other modifications may be effected without leaving the true spirit of the present invention.

As described above, according to the present invention, when the ice particles and the dry-ice particles are separately prepared and then mixed and the mixture of the ice particles and the dry-ice particles is blasted against an object to be cleaned, the evaporation of the dry-ice powder can be suppressed by the ice particles and the screening of an object to be cleaned by the smoke of evaporated dry ice can be prevented. Furthermore, the wet type blasting can be carried out because the ice particles are crushed and become water so that the contaminated particles can be prevented from being scattered or from being discharged through a filter into the surrounding atmosphere. In addition, the object can be effectively cleaned with the dry-ice particles so that the cleaning efficiency can be improved.

According to the present invention, when the dry-ice particles are blasted against the object to be cleaned under the presence of a surface-active agent, the contaminated particles can be attracted by the surface-active agent and can be withdrawn, so that the contaminated particles can be prevented from being scattered into the surrounding atmosphere. In addition, the disposal of the radioactive contaminants can be facilitated.

What is claimed is:

1. A cleaning method comprising: blasting a mixture of abrasive dry-ice particles and abrasive ice particles against an object to be cleaned.

* * * * *

UNITED STATES PATENT AND TRADEMARK OFFICE

CERTIFICATE OF CORRECTION

PATENT NO. : 4,655,847

DATED : April 7, 1987

INVENTOR(S) : Tsuyoshi Ichinoseki et al

It is certified that error appears in the above-identified patent and that said Letters Patent are hereby corrected as shown below:

Title page, Item [73] should be added as follows:

[73]Assignees: Doryokuro Kakunenryo Kaihatsu Jigyodan; Ishikawajima-Harima Jukogyo Kabushiki Kaisha, both of Tokyo, Japan

Signed and Sealed this

Twenty-sixth Day of January, 1988

*Attest:*

DONALD J. QUIGG

*Attesting Officer*

*Commissioner of Patents and Trademarks*